US007352337B2

(12) United States Patent
Yegin et al.

(10) Patent No.: US 7,352,337 B2
(45) Date of Patent: Apr. 1, 2008

(54) PORTABLE SDARS-RECEIVING DEVICE WITH INTEGRATED AUDIO WIRE AND ANTENNA

(75) Inventors: Korkut Yegin, Grand Blanc, MI (US); Daniel G. Morris, Ovid, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 117 days.

(21) Appl. No.: 11/437,160

(22) Filed: May 19, 2006

(65) Prior Publication Data

US 2006/0238435 A1 Oct. 26, 2006

Related U.S. Application Data

(62) Division of application No. 10/999,385, filed on Nov. 30, 2004, now Pat. No. 7,180,472.

(60) Provisional application No. 60/574,520, filed on May 26, 2004.

(51) Int. Cl.
*H01Q 1/36* (2006.01)
*H01Q 1/24* (2006.01)

(52) U.S. Cl. ..... 343/895; 343/702

(58) Field of Classification Search ..... 343/702, 343/895

See application file for complete search history.

(56) References Cited

U.S. PATENT DOCUMENTS

| | | | | |
|---|---|---|---|---|
| 2,899,549 | A | 8/1959 | Potter | 455/269 |
| 3,827,053 | A | 7/1974 | Willie et al. | 343/701 |
| 5,828,348 | A | 10/1998 | Tassoudji et al. | 343/895 |
| 5,990,847 | A | 11/1999 | Filipovic et al. | 343/895 |
| 6,356,773 | B1 * | 3/2002 | Rinot | 455/575.1 |
| 6,421,028 | B1 | 7/2002 | Ohgren et al. | 343/895 |
| 6,421,029 | B1 * | 7/2002 | Tanabe | 343/895 |
| 6,538,611 | B2 | 3/2003 | Noro | 343/725 |
| 6,587,081 | B2 * | 7/2003 | Noro et al. | 343/895 |
| 6,653,987 | B1 * | 11/2003 | Lamensdorf et al. | 343/895 |
| 6,791,509 | B2 | 9/2004 | Noro | 343/895 |
| 7,257,422 | B2 * | 8/2007 | Loprete | 455/550.1 |
| 2002/0149539 | A1 | 10/2002 | Noro et al. | 343/895 |
| 2004/0108967 | A1 | 6/2004 | Fujimura et al. | 343/895 |

FOREIGN PATENT DOCUMENTS

| | | |
|---|---|---|
| GB | 962100 | 6/1964 |

OTHER PUBLICATIONS

EP 05076197—European Search Reports dated Aug. 11, 2005 & Oct. 21, 2005.

Petros, A, et al: "folded quadrifilar helix antenna"; IEEE Antennas and Propagation Society International Symposium. 2001 Digest. APS. Boston, MA, Jul. 8-13, 2001 New York, NY, IEEE, US, vol. 1 or 4, pp. 569-572, XPO10564703.

* cited by examiner

*Primary Examiner*—Hoang V. Nguyen
(74) *Attorney, Agent, or Firm*—Jimmy L. Funke

(57) ABSTRACT

An antenna having a plurality of elongated conductors is disclosed. The elongated conductors have a substantially straight portion and a substantially helical portion.

19 Claims, 3 Drawing Sheets

PORTABLE SDARS-RECEIVING DEVICE WITH INTEGRATED AUDIO WIRE AND ANTENNA

CROSS REFERENCE TO RELATED APPLICATION

This application is a divisional of U.S. application Ser. No. 10/999,385 filed Nov. 30, 2004 now U.S. Pat. No. 7,180,472. This application claims priority to U.S. provisional application 60/574,520 filed on May 26, 2004, which is incorporated herein by reference in its entirety.

TECHNICAL FIELD

The present invention relates generally to antenna systems for satellite digital audio radio service and more specifically to a quadrifilar helical antenna used in satellite digital audio radio service communications.

BACKGROUND

Communications between terrestrial devices such as radios and earth-orbiting satellites are well known. A commercial application of these satellite systems is satellite digital audio radio service (SDARS). SDARS systems broadcast high quality uninterrupted audio through satellites and earth-based stations. SDARS systems typically include an antenna with a low-noise amplifier and a receiver. The antenna initially receives encoded signals from the satellites and/or terrestrial transmitters. The amplifier, which is conventionally housed within the antenna, amplifies the received signal. The receiver decodes the transmitted signal and provides the signal to the radio.

Referring to FIG. 1, a simplified block diagram of a typical satellite digital audio radio service (SDARS) system is shown. An Earth-orbiting satellite 11 broadcasts SDARS signals. The SDARS signals may be received by a SDARS-receiving device 14, such as a radio (shown) or a television (for example), and/or they may be received by stationary transmitters 12. The terrestrial transmitters 12 re-broadcast the SDARS signals, which may then be received by SDARS-receiving devices 14. The SDARS-receiving device 14 includes an antenna (not shown in FIG. 1) to receive the broadcast SDARS signals. Typical SDARS-receiving devices 14 further include other components (not shown), such as an amplifier, receiver, speakers, etc. to convert the SDARS signals into audible sounds and/or visual images.

Terrestrial SDARS-receiving devices 14 commonly use a quadrifilar helix antenna to receive SDARS signals. An exemplary known quadrifilar helix antenna is shown in FIG. 2. The illustrated quadrifilar helix antenna 16 includes four conductive elements 18*a*-18*d*, such as electrically-conductive wires, arranged to define two separate helically twisted loops. Each of the loops is connected between an antenna feed and a ground plane, and the conductive elements each fold over itself at a distal point from the antenna feed and the ground plane to form a loop, as shown in FIG. 2. The two conductive elements of a quadrifilar helix antenna 16 are excited in phase quadrature. That is, each conductive element is excited at a 90° phase shift from the adjacent conductive element.

Conventional quadrifilar helix antennas used in SDARS-receiving devices have a number of disadvantages. Known quadrifilar helix antennas are most effective when receiving signals from a satellite at zenith. Known quadrifilar helix antennas are typically less effective at receiving SDARS signals transmitted from low elevation satellites and from stationary terrestrial transmitters. As a result, some SDARS-receiving devices include a second antenna dedicated to receiving SDARS signals from stationary terrestrial transmitters. Further, known quadrifilar helix antennas have limited utility for portable and/or wearable SDARS-receiving devices, such as personal radios, headphones, etc. The interference created by the human body degrades the ability of conventional quadrifilar helix antennas to receive SDARS signals. Moreover, the fact that known quadrifilar helix antennas require a relatively large ground plane makes using such antennas in portable/wearable devices impractical.

The embodiments described below were developed in light of these and other disadvantages of known quadrifilar helix antennas.

SUMMARY

An antenna for receiving satellite digital audio radio service (SDARS) communications is disclosed. The antenna has a plurality of elongated conductors. The elongated conductors have both a straight portion and a helical portion.

DETAILED DESCRIPTION

Figure 2:
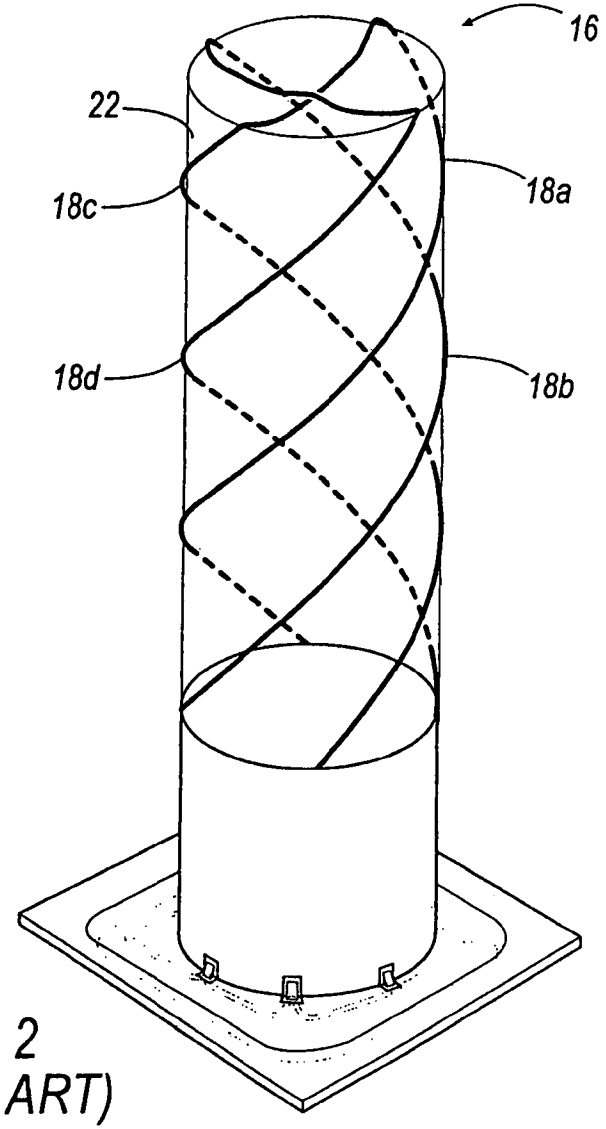
FIG. 2 (PRIOR ART)
FIG. 2 is an illustration of a known quadrifilar helix antenna.
Figure 1:
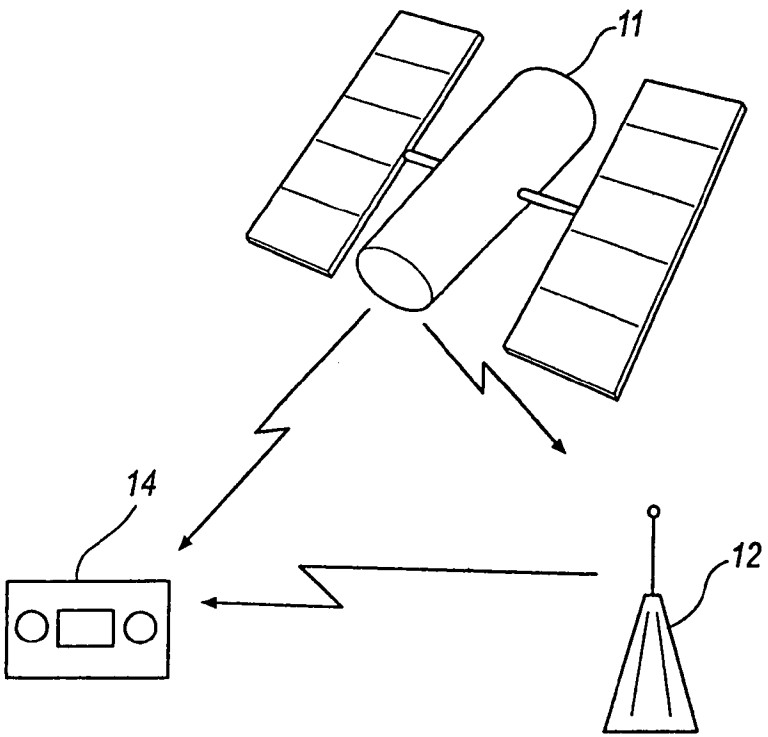
FIG. 1 generally illustrates an Earth-orbiting satellite, a terrestrial transmitter, and an SDARS-receiving device.
Figure 3B:
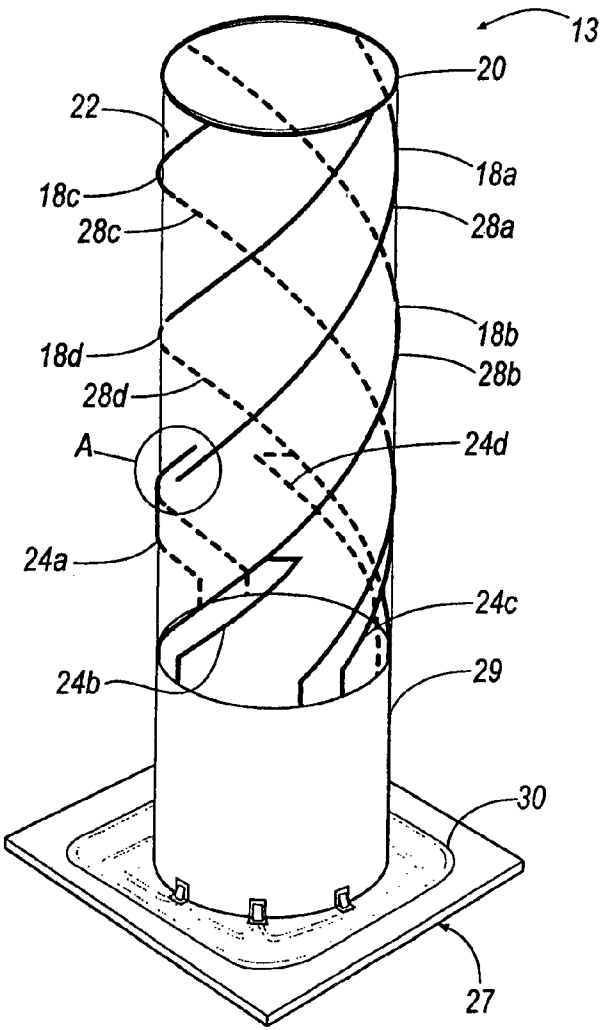
FIGS. 3A and 3B illustrate different embodiments of a quadrifilar helix antenna according to an embodiment of the present invention.
Figure 3A:
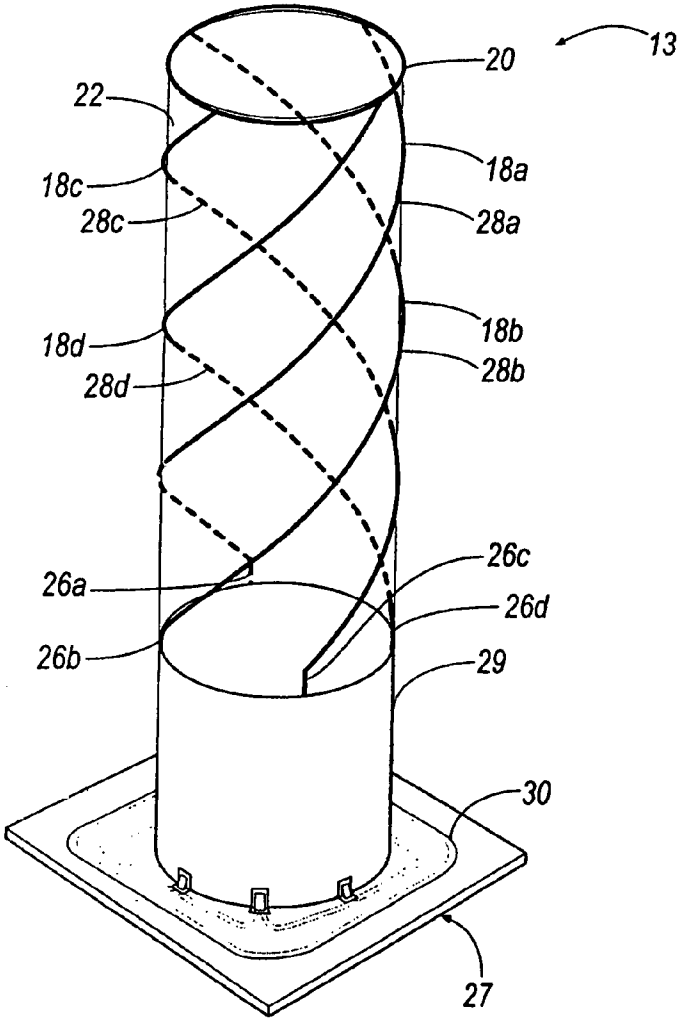

FIG. 3A illustrates an embodiment of a quadrafilar helix antenna 13 for an SDARS-receiving device. Antenna 13 includes a plurality of elongated conductors 18*a*-18*d*, such as copper wires for example. The conductors 18 are mounted in a mylar base 29, though other types of mounting structures could be used. Each conductor 18 has a substantially straight portion 26*a*-26*d* near the base 29 (shown in FIGS. 3A and 3B as extending directly from the base 29) and a substantially helical portion 28*a*-28*d* thereafter. The helical portion 28*a*-28*d* of each conductor 18 further extends away from the base 29. In FIG. 3A, the straight portion 26*a*-26*d* is shown as significantly shorter than the helical portion 28*a*-28*d*. The respective lengths of the straight portion 26*a*-26*d* and the helical portion of the conductors 18 may be adjusted relative to each other to optimize signal reception. At the point of the antenna 13 most distal from the base 29, the conductors 18 are electrically connected together by a substantially circular conductor 20, such as a copper wire. The conductors 18 together approximately define a hollow cylinder shape. The elongated conductors may wrap around a solid core material, such as a dielectric 22, which may be a ceramic material for example.

As shown in FIG. 3A, antenna 13 may be electrically coupled to a phasing network at the base 29. The phasing network includes a substrate 27 and a conductive transmission line 30, which electrically couples antenna 13 to other components in an SDARS-receiving device, such as an amplifier (not shown). The phasing network may excite conductors 18 in phase quadrature as is known in the art.

FIG. 3B illustrates another embodiment of antenna 13. In this embodiment, conductors 18 are capacitively loaded, which enables the antenna 13 to be tuned to a particular frequency. Conductors 18 may be capacitively loaded by including a break in one or more of the conductors 18 and maintaining the ends of the conductor at the point of the break in close proximity to each other, as shown at segment A of FIG. 3B. This structure effectively creates a capacitive effect at the point of the break (segment A). The voltage differential across the break (segment A) tunes the antenna 13. Other known methods for capacitively loading and/or tuning antenna 13 may also be used.

The embodiment of antenna 13 in FIG. 3B further includes conductive tuning stubs 24 coupled to conductors 18. Tuning stubs 24 enable impedance matching between the antenna 13 and other proximate components, such as an amplifier, which improves transmission of the SDARS signal from the antenna to other components, such as an amplifier. The impedance of the antenna 13 may be adjusted by varying the length of the tuning stubs 24*a*-24*d*.

Figure 4:
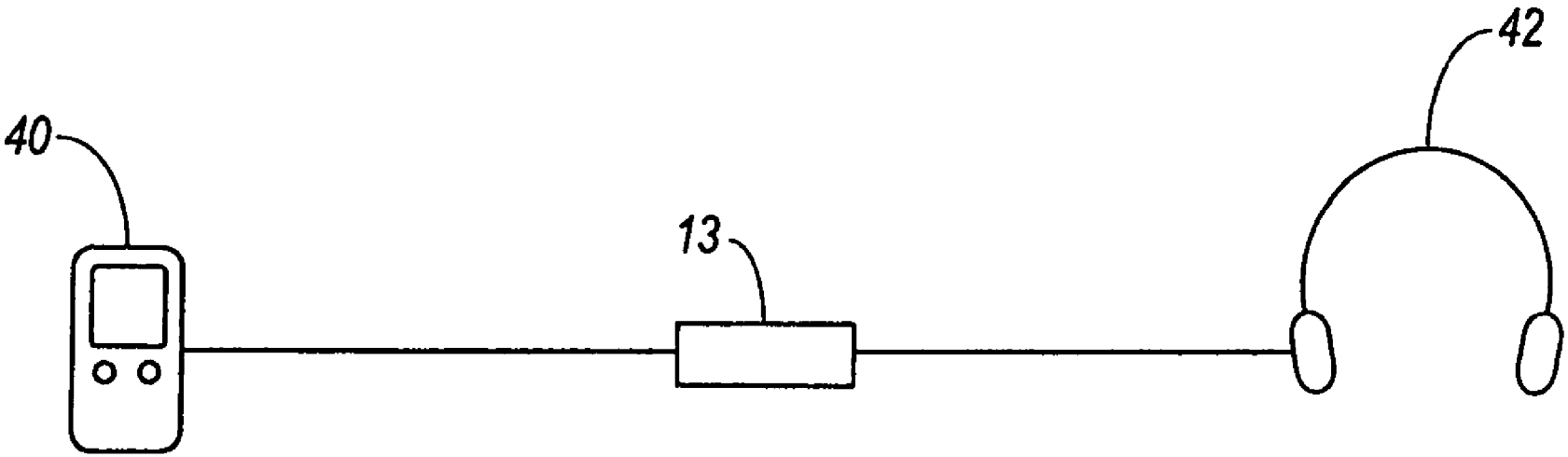
FIG. 4 illustrates an exemplary embodiment of a portable SDARS-receiving system that incorporates a quadrifilar helix antenna, according to the embodiments disclosed herein.

The above-described embodiments have resulted in the ability to reduce the overall length and volume of the antenna 13 relative to known SDARS antennas. Further, the described configurations have demonstrated increased reception efficiency, including reception of signals from relatively low-elevation satellites and stationary terrestrial transmitters. Additionally, the described configurations have demonstrated less susceptibility to interference from human bodies, thus better enabling them to be used in SDARS-receiving devices configured to be used in close proximity to human bodies, such as personal wearable radios for example. In certain embodiments—for example, when the disclosed SDARS antenna is used in connection with a portable and/or wearable SDARS-receiving device—a hollow bore may be made longitudinally through the dielectric core 22. Audio wires, such as for headphones, may be routed through the bore, causing the antenna to appear to be coupled "around" the headphone wire, which improves the aesthetics of the SDARS-receiving device. As shown in FIG. 4, the antennas 13 described herein can be configured to allow audio wires to pass there through to electrically couple, for example, ear phones 42 to a primary housing 40 (housing an amplifier, receiver, etc.).

Various other modifications to the present invention may occur to those skilled in the art to which the present invention pertains. Other modifications not explicitly mentioned herein are also possible and within the scope of the present invention. It is the following claims, including all equivalents, which define the scope of the present invention.

The invention claimed is:

1. A portable SDARS-receiving device, comprising:

a primary housing unit;

at least one ear phone electrically coupled to said primary housing using by an audio wire; and an antenna, said antenna comprising:

a plurality of elongated conductors together forming a substantially cylindrical shape;

said elongated conductors having a substantially straight portion and a substantially helical portion; and a substantially circular conductor electrically coupled to said elongated conductors;

wherein said antenna is positioned between said primary housing unit and said ear phone such that said audio wire passes through said substantially cylindrical shape defined by said elongated conductors.

2. The SDARS-receiving device of claim 1, further comprising:

a solid core within said substantially cylindrical shape defined by said elongated conductors, said solid core having a longitudinal bore therethrough; and wherein said audio wire passes through said longitudinal bore.

3. A portable SDARS-receiving device, comprising:

a primary housing unit; and at least one ear phone electrically coupled to said primary housing by an integrated audio wire and antenna, the antenna comprising a plurality of elongated conductors, said elongated conductors having a substantially straight portion and a substantially helical portion.

4. The portable SDARS-receiving device of claim 3, wherein said elongated conductors are coupled to and extend from a base.

5. The portable SDARS-receiving device of claim 4, further comprising a substantially circular conductor that electrically couples said elongated conductors together at a distal end from said base.

6. The portable SDARS-receiving device of claim 4, wherein said substantially straight portion is positioned between said base and said substantially helical portion.

7. The portable SDARS-receiving device of claim 3, wherein said substantially straight portion is shorter than said substantially helical portion.

8. The portable SDARS-receiving device of claim 3, wherein said plurality of elongated conductors together form a substantially cylindrical shape.

9. The portable SDARS-receiving device of claim 8, wherein said elongated conductors are wrapped around a solid core.

10. The portable SDARS-receiving device of claim 9, wherein said solid core includes a longitudinal bore therethrough.

11. The portable SDARS-receiving device of claim 9, wherein said solid core comprises a dielectric material.

12. The portable SDARS-receiving device of claim 3, wherein said elongated conductors are capacitively loaded.

13. The portable SDARS-receiving device of claim 3, further comprising tuning stubs coupled to said elongated conductors.

14. The portable SDARS-receiving device of claim 3, further comprising a phasing network that is electrically coupled to said elongated conductors.

15. A portable SDARS-receiving device, comprising:

a primary housing unit; and at least one ear phone electrically coupled to said primary housing by an integrated audio wire and antenna, the antenna comprising a plurality of elongated conductors, said elongated conductors being substantially helical and a substantially circular conductor that electrically couples said elongated conductors.

16. The portable SDARS-receiving device of claim 15, wherein said elongated conductors are coupled to and extend from a base, and wherein said substantially circular conductor electrically couples aid elongated conductors together at a distal end from said base.

17. A portable SDARS-receiving device, comprising:

a primary housing unit; and at least one ear phone electrically coupled to said primary housing by an integrated audio wire and antenna, the antenna comprising a plurality of elongated conductors wrapped around a dielectric core;

said elongated conductors having a substantially straight portion and a substantially helical portion; and a substantially circular conductor electrically coupled to said elongated conductors.

18. The portable SDARS-receiving device of claim 17, said antenna further comprising a base to which said elongated conductors are coupled, and wherein said substantially circular conductor couples said elongated conductors at a distal end from said base.

19. The portable SDARS-receiving device of claim 17, said antenna further comprising a base to which said elongated conductors are coupled, and wherein said substantially straight portion is positioned between said base and said substantially helical portion.

* * * * *